US011459821B2

(12) United States Patent
Fries et al.

(10) Patent No.: US 11,459,821 B2
(45) Date of Patent: Oct. 4, 2022

(54) HEADRAIL FOR AN ARCHITECTURAL-STRUCTURE COVERING

(71) Applicant: Hunter Douglas Inc., Pearl River, NY (US)

(72) Inventors: Timothy William Fries, Louisville, CO (US); Kenneth M. Faller, Thornton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 376 days.

(21) Appl. No.: 16/747,831

(22) Filed: Jan. 21, 2020

(65) Prior Publication Data

US 2020/0248501 A1 Aug. 6, 2020

Related U.S. Application Data

(60) Provisional application No. 62/801,579, filed on Feb. 5, 2019.

(51) Int. Cl.
*E06B 9/323* (2006.01)
*E06B 9/322* (2006.01)
*E06B 9/262* (2006.01)

(52) U.S. Cl.
CPC ..... *E06B 9/323* (2013.01); *E06B 9/322* (2013.01); *E06B 9/262* (2013.01)

(58) Field of Classification Search
CPC ..... E06B 2009/2423; E06B 2009/2435; E06B 2009/2477; E06B 2009/2622; E06B 2009/2625; E06B 2009/2627; E06B 2009/2452; E06B 2009/2458; E06B 9/323; E06B 9/262
USPC ..... 160/19, 32, 84.03, 84.08; 248/251
See application file for complete search history.

(56) References Cited

U.S. PATENT DOCUMENTS 3,927,437 A 12/1975 Ford
4,607,677 A * 8/1986 Comeau ..... E06B 9/388 160/902
4,813,468 A * 3/1989 Fraser ..... E06B 9/32 160/84.03
5,180,130 A 1/1993 McMichael
(Continued)

FOREIGN PATENT DOCUMENTS

EP 1936104 A1 6/2008
EP 2019184 A2 1/2009
(Continued)

*Primary Examiner* — Johnnie A. Shablack
(74) *Attorney, Agent, or Firm* — KDB Firm PLLC

(57) ABSTRACT

A headrail for use with an architectural-structure covering including one or more features to facilitate easier assembly and/or manufacturing. Additionally, and/or alternatively, the headrail may include one or more features to provide improved operation and/or aesthetics. For example, the headrail may include a slat slidably received within an interior cavity of the headrail. The components can be coupled to the slat prior to insertion of the slat into the headrail thus facilitating easier assembly. In addition, and/or alternatively, the slat may include a light-blocking element. In addition, and/or alternatively, a covering portion of the architectural-structure covering may include face and back fabrics that are separately and independently associated with the headrail to facilitate improved aesthetics in a top portion of the covering.

18 Claims, 11 Drawing Sheets

(56) References Cited

U.S. PATENT DOCUMENTS

| | | | | |
|---|---|---|---|---|
| 5,205,334 | A | 4/1993 | Judkins | |
| 5,533,560 | A | 7/1996 | Morris | |
| 5,626,177 | A * | 5/1997 | Colson | E06B 9/262 160/168.1 V |
| 5,690,156 | A * | 11/1997 | Ruggles | E06B 9/386 160/84.04 |
| 5,927,367 | A | 7/1999 | Toti | |
| 6,095,222 | A | 8/2000 | Voss | |
| 6,431,247 | B1 | 8/2002 | Harrison, Jr. et al. | |
| 6,662,845 | B1 | 12/2003 | Palmer | |
| 6,843,299 | B2 * | 1/2005 | Judkins | E06B 9/323 160/902 |
| 6,850,017 | B1 | 2/2005 | Domel et al. | |
| 6,866,078 | B1 | 3/2005 | Lin | |
| 6,899,156 | B2 * | 5/2005 | Tyner | E06B 9/324 160/902 |
| 6,983,784 | B2 * | 1/2006 | Anderson | E06B 9/36 160/168.1 V |
| 7,117,918 | B2 | 10/2006 | Franssen | |
| 7,163,043 | B2 | 1/2007 | Huang | |
| 7,290,582 | B2 * | 11/2007 | Lin | A47H 2/00 160/124 |
| 7,360,573 | B2 * | 4/2008 | Yu | E06B 9/38 160/84.05 |
| 7,493,932 | B2 | 2/2009 | Cheng | |
| 7,571,756 | B2 * | 8/2009 | Smith | E06B 9/262 160/87 |
| 7,703,500 | B2 | 4/2010 | Wen et al. | |
| 7,743,813 | B2 | 6/2010 | Haffamier et al. | |
| 7,832,450 | B2 | 11/2010 | Brace et al. | |
| 7,942,184 | B2 | 5/2011 | Cech et al. | |
| 8,176,964 | B2 | 5/2012 | Janach | |
| 8,540,005 | B2 * | 9/2013 | Baugh | E06B 9/322 160/310 |
| 8,584,728 | B2 * | 11/2013 | Truett | E06B 9/323 160/84.01 |
| 8,789,575 | B2 * | 7/2014 | Shih | E06B 9/262 160/84.05 |
| 8,794,296 | B2 * | 8/2014 | Shih | E06B 9/262 160/84.06 |
| 8,807,192 | B2 | 8/2014 | Marocco | |
| 8,820,388 | B2 * | 9/2014 | Mullet | E06B 9/322 160/310 |
| 9,062,493 | B2 * | 6/2015 | Marocco | E06B 9/40 |
| 9,593,528 | B2 | 3/2017 | Anderson | |
| 9,644,422 | B2 | 5/2017 | Marocco | |
| 9,797,188 | B2 | 10/2017 | Rettig | |
| 9,879,477 | B2 | 1/2018 | Anderson | |
| 9,885,812 | B2 | 2/2018 | Malkan | |
| 9,909,361 | B2 | 3/2018 | Buccola, Jr. et al. | |
| 10,697,233 | B2 * | 6/2020 | Schwandt | E06B 9/266 |
| 2006/0021711 | A1 | 2/2006 | Haffamier | |
| 2006/0027336 | A1 * | 2/2006 | Lin | E06B 9/262 160/84.01 |
| 2006/0048904 | A1 * | 3/2006 | Gruner | E06B 9/262 160/84.05 |
| 2006/0151126 | A1 | 7/2006 | Lampe | |
| 2006/0249260 | A1 | 11/2006 | Nien | |
| 2008/0196843 | A1 | 8/2008 | Nien et al. | |
| 2008/0230187 | A1 | 9/2008 | Caron | |
| 2009/0101288 | A1 | 4/2009 | Yu et al. | |
| 2009/0101293 | A1 | 4/2009 | Anderson et al. | |
| 2010/0243589 | A1 * | 9/2010 | Truett | E06B 9/262 211/124 |
| 2012/0031569 | A1 * | 2/2012 | Elinson | E06B 9/262 160/84.05 |
| 2012/0103537 | A1 | 5/2012 | Dogger | |
| 2012/0193038 | A1 | 8/2012 | Corey et al. | |
| 2013/0087296 | A1 | 4/2013 | Mullet et al. | |
| 2017/0204657 | A1 | 7/2017 | Wen | |
| 2017/0226796 | A1 | 8/2017 | Wen | |
| 2017/0234062 | A1 | 8/2017 | Schwandt et al. | |
| 2017/0362889 | A1 | 12/2017 | Hall et al. | |
| 2018/0128046 | A1 | 5/2018 | Anderson | |
| 2018/0135353 | A1 | 5/2018 | Wen et al. | |
| 2019/0106938 | A1 | 4/2019 | Foley et al. | |
| 2019/0249433 | A1 * | 8/2019 | Guest | E06B 9/58 |
| 2020/0284090 | A1 * | 9/2020 | Schulman | E06B 9/322 |
| 2021/0254401 | A1 * | 8/2021 | Liang | E06B 9/388 |
| 2022/0081968 | A1 * | 3/2022 | Huang | E06B 9/262 |

FOREIGN PATENT DOCUMENTS

| | | |
|---|---|---|
| EP | 2060733 B1 | 6/2015 |
| EP | 3015638 B1 | 11/2017 |
| GB | 2425323 B | 10/2006 |

* cited by examiner

HEADRAIL FOR AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/801,579, filed Feb. 5, 2019, entitled "A Headrail for an Architectural-Structure Covering," which application is incorporated by reference herein in its entirety.

FIELD OF THE DISCLOSURE

The present disclosure relates generally to architectural-structure coverings, and more particularly to a headrail including one or more enhanced features to facilitate easier assembly and/or improved operation of the architectural-structure covering.

BACKGROUND OF THE DISCLOSURE

Architectural-structure coverings for architectural openings and/or structures, such as windows, doors, archways, portions of a wall, and the like (collectively an architectural structure without the intent to limit), have taken numerous forms for many years. Architectural-structure coverings may take many different forms. For example, such coverings can include roller blinds, vertical blinds, wood blinds, Roman shades, cellular blinds, etc. One known architectural-structure covering includes a covering such as a fabric that is movable between an extended position and a retracted position. For example, the covering can be vertically extendable or retractable (e.g., able to be lowered or raised, respectively, in a vertical direction) between an extended position and a retracted position for obscuring and exposing the underlying architectural structure.

To move the covering between the extended and retracted positions, some architectural-structure coverings include a rotatable member (e.g., a rod or a roller). Rotation of the rotatable member in a first direction may retract the covering while rotation of the rotatable member in a second, opposite direction may extend the covering. The covering portion of the architectural-structure covering may be gathered or stacked adjacent to, or wrapped around, the rotatable member. For example, some retractable coverings include a plurality of folds that are raised or lowered as lift cords are wrapped about or unwrapped from the rotatable member. The lift cords may be coupled to the rotatable member, pass through the covering portion, and may be coupled to, for example, a bottom rail. Thereafter, rotation of the rotatable member in a first direction wraps the lift cords about the rotatable member causing the covering portion to retract adjacent to the rotatable member while rotation in a second direction causes the lift cords to unwrap about the rotatable member causing the covering portion to move in an extended configuration. Alternatively, in various embodiments, the covering may be wrapped around the rotatable member in the retracted position. For example, some retractable coverings include a flexible covering suspended from the rotatable member. The covering can either be wrapped about the rotatable member to retract the covering or unwrapped from the rotatable member to extend the covering. Regardless of the form of the covering, rotation of the rotatable member generally causes movement of the covering of the architectural-structure covering. To actuate movement of the rotatable member, and thus the covering of the architectural-structure covering, an operating system may be operably coupled to the rotatable member.

The operating system may be operatively associated with an operating element, for example, a cord, a chain, a tilt wand, or the like. The operating element may be manipulated by a human operator to move the covering between the extended and retracted positions. Alternatively, the operating system may include a motorized controller to lower or raise the covering. For example, a motorized drive motor (e.g., an electric motor) can be provided to move the covering between the extended position and the retracted position. In one embodiment, the operating element may include a hand-held remote or the like. In alternate embodiments, the covering may be moved by gripping and manipulating the bottom rail of the architectural-structure covering.

Additionally, top down/bottom up architectural-structure coverings ("TDBU covering") have been developed. Generally speaking, a TDBU covering includes a headrail, a movable upper rail and a movable bottom rail with the covering extending between the upper and bottom rails. The operating system for such coverings generally utilize lift cords which can independently raise or lower the upper and bottom rails so that the covering becomes a top down covering by lowering the upper rail toward the bottom rail, or a bottom up covering by raising the bottom rail toward the upper rail. In addition, the upper and bottom rails can be positioned at any elevation within the architectural structure and with any selected spacing between the upper and bottom rails for variety in positioning of the covering across the architectural structure.

It is with respect to these and other considerations that the features and/or aspects of the present disclosure may be useful.

SUMMARY

This Summary is provided to introduce in a simplified form, a selection of concepts that are further described below in the Detailed Description. This Summary is not intended to identify key features or essential features of the claimed subject matter, nor is it intended as an aid in determining the scope of the claimed subject matter.

Disclosed herein is an architectural-structure covering. The architectural-structure covering may include a covering movable between an extended position and a retracted position, an operating system (e.g., a clutch, a gear, a motor, a drive train, a gear train, combinations thereof, etc.) for moving the covering between the extended and retracted positions, and an operating element (e.g., a cord, a chain, a motorized motor/remote control, or the like) operatively associated with the operating system to move the covering between the extended and retracted positions.

Disclosed herein is also a headrail for use with an architectural-structure covering. In one example embodiment, the headrail may include a slat slidably receivable within an interior cavity of the headrail. The slat is adapted and configured to receive one or more components thereon prior to insertion of the slat into the interior cavity of the housing thereby facilitating easier assembly. That is, in one example embodiment, the slat and the headrail may be configured so that the slat includes first and second recesses arranged and configured to receive first and second ledges, respectively, associated with the headrail, or vice-versa. The slat may be arranged and configured so that the slat is slidably receivable within the headrail with a bottom surface of the slat resting on the first and second ledges.

Additionally, and/or alternatively, in one example embodiment, the slat may further include a light-blocking element arranged and configured to inhibit light passage between any gaps between the headrail and a movable upper rail in a top down/bottom up architectural-structure covering when the movable upper rail is positioned adjacent to the headrail.

Additionally, and/or alternatively, another concept disclosed herein is a covering having a face fabric intermittently coupled to a back fabric, and a plurality of lift elements passing between the face and back fabrics and operatively coupled to the operating system. The face fabric and the back fabric are coupled to an upper portion of headrail or slat at independent and spaced apart locations.

Figure 1:
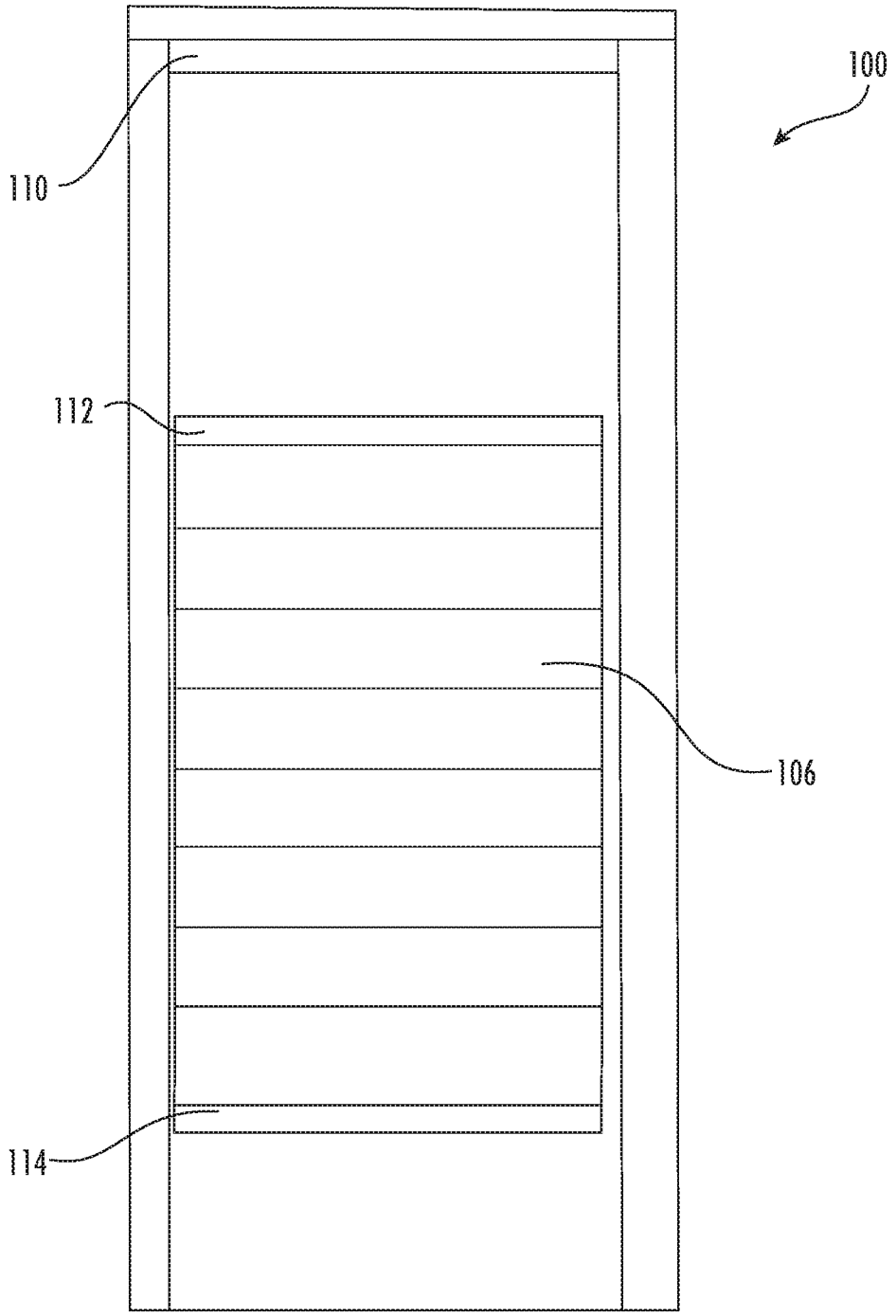
FIG. 1 is a front view illustrating an example embodiment of an architectural-structure covering.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

Various features, aspects, or the like of an architectural-structure covering and a headrail for use with an architectural-structure covering will now be described more fully hereinafter with reference to the accompanying drawings, in which one or more aspects of the architectural-structure covering and/or headrail will be shown and described. It should be appreciated that the various features, aspects, or the like may be used independently of, or in combination, with each other. It will be appreciated that the architectural-structure covering and/or headrail as disclosed herein may be embodied in many different forms and should not be construed as being limited to the embodiments set forth herein. Rather, these embodiments are provided so that this disclosure will convey certain illustrations of aspects of the architectural-structure covering and/or headrail to those skilled in the art. In the drawings, like numbers refer to like elements throughout unless otherwise noted.

As will be described in greater detail below, a headrail according to the present disclosure may include one or more features to facilitate assembly and/or manufacturing. Additionally, and/or alternatively, the headrail may include one or more features to provide improved operation and/or aesthetics.

For example, in accordance with one aspect of the present disclosure, a slat on which operating components are mounted is coupled to or mounted to a headrail. During manufacturing and assembly, the slat is movably coupled such as, for example, slidably coupled or received within the headrail. The slat is adapted and configured to receive all or some of the components such as, for example, the operating system including, for example, motor(s), rotatable member(s), spools, lift cords, etc. thereon. Thereafter, the slat can be slidably positioned within the headrail via, for example, slidably inserting the slat including the components thereon from one end of the headrail. In this manner, the components positioned within the headrail are initially coupled to the slat and coupled together as necessary outside of the tight confines of the headrail (e.g., the components may be coupled to the slat prior to insertion into the headrail), thus facilitating easier assembly. Thereafter, once the components have been coupled to the slat and coupled to one another as necessary, the slat can be slid into position relative to the headrail.

In addition, and/or alternatively, in accordance with a separate and independent aspect of the present disclosure, particularly when used in combination with a TDBU covering, a headrail and, more specifically, a slat, includes a light-blocking element or member (used interchangeably without the intent to limit) integrally formed with the slat. The light-blocking element is adapted and configured to prevent, or at least inhibit, any light from passing between the headrail and the movable upper rail in the TDBU covering.

In addition, and/or alternatively, in accordance with another separate and independent aspect of the present disclosure that may be used in combination with the one or more slats disclosed herein, or which may be used in an architectural-structure covering without the one or more slats disclosed herein, the covering portion of an architectural-structure covering with face and back fabrics are separately and independently associated with an upper portion of an architectural-structure covering including, for example, a headrail, a slat as disclosed herein, or the like. That is, the face and back fabrics are separated from each other at a top portion or fold thereof (e.g., the top portion or fold of the covering positioned adjacent to the headrail). Thereafter, each of the face and back fabrics may be separately and independently coupled to, for example, the headrail, the rotatable member (e.g., a rotatable roller), or the like. In one example embodiment in accordance with the present disclosure, the face and back fabrics may be separately and independently coupled to a slat, the slat including some or none of the features of the slat disclosed herein.

In accordance with one aspect of the present disclosure, a headrail for use with an architectural-structure covering is disclosed. The architectural-structure covering including a covering movable between an extended position and a retracted position, and an operating system to move the covering between the extended and retracted positions. The headrail comprising a housing including a front wall, a back wall, and a top wall extending between the front wall and the back wall. The front wall, the back wall, and the top wall defining an interior cavity. The housing further including a first ledge extending into the interior cavity from the front wall and a second ledge extending into the interior cavity from the back wall. The headrail further comprising a slat including a top surface and a bottom surface opposite the top surface. The slat being slidably receivable within the interior cavity of the housing with the bottom surface of the slat resting on the first and second ledges. The slat being adapted and configured to receive the operating system thereon prior to insertion of the slat into the interior cavity of the housing.

In one embodiment, the slat further comprises first and second recesses formed in the slat arranged and configured to receive the first and second ledges, respectively, of the housing; and first and second legs formed in the slat positioned beneath the first and second recesses, respectively, arranged and configured to minimize upward movement of the slat.

In one embodiment, in accordance with another separate and independent aspect of the present disclosure, the slat comprises a light-blocking element extending from a bottom surface of the slat arranged and configured to inhibit light passage.

In addition, and/or alternatively, a method for assembling a headrail of an architectural-structure covering is disclosed. The architectural-structure covering including a headrail and a covering movable between an extended position and a retracted position. The method comprising: coupling a plurality of components to a top surface of a slat; and slidably inserting the slat and the plurality of components coupled thereto into an interior cavity of the headrail from a first end of the headrail; wherein the slat rests on first and second inwardly protruding ledges of the headrail.

In addition, and/or alternatively, in accordance with another separate and independent aspect of the present disclosure, an architectural-structure covering is disclosed. The architectural-structure covering comprising: a covering movable between an extended position and a retracted position; and an operating system for moving the covering between the extended and retracted positions; wherein: the covering includes a face fabric, a back fabric intermittently coupled to the face fabric, and a plurality of lift elements passing between the face and back fabrics, the plurality of lift elements operatively coupled to the operating system; and the face fabric and the back fabric are coupled to one of a rotatable roller, a headrail, and a slat of the architectural-structure covering at independent and spaced apart locations.

As will be described herein, features according to the present disclosure may be used with any suitable architectural-structure covering now known or hereafter developed. In addition, the various features described herein may be used separately or jointly in any combination. As such, the present disclosure should not be limited to the specific illustrations and details described herein unless specifically claimed.

Referring to FIG. 1, an example embodiment of an architectural-structure covering 100 that may be used in accordance with the present disclosure is illustrated. The architectural-structure covering 100 may include a covering 106 movable between an extended position and a retracted position, an operating system to move the covering 106 between the extended and retracted positions, and an operating element operatively associated with the operating system to move the covering 106 between the extended and retracted positions.

As illustrated in FIG. 1, in one embodiment, the architectural-structure covering 100 may be in the form of a TDBU covering. As illustrated, a TDBU covering generally includes a headrail 110, a movable upper rail 112, and a movable bottom rail 114 with the covering 106 extending between the movable upper and bottom rails 112, 114.

The movable upper and bottom rails 112, 114 are separately and independently movable (e.g., capable of being raised or lower) so that the covering 106 becomes a top down covering by lowering the movable upper rail 112 toward the movable bottom rail 114, or a bottom up covering by raising the movable bottom rail 114 toward the movable upper rail 112. Further, the movable upper and bottom rails 112, 114 can be positioned at any elevation within the architectural structure and with any selected spacing between the movable upper and bottom rails 112, 114 for variety in positioning of the covering 106 across the architectural structure.

Although a particular example of an architectural-structure covering 100 is shown in FIG. 1, many different types and styles of architectural-structure coverings exist and can be employed in place of the example illustrated in FIG. 1. As such, it should be understood that features of the present disclosure may be used in combination with any suitable architectural-structure covering now known or hereafter developed and thus features of the present disclosure should not be limited to any particular type of architectural-structure covering. For example, it should be appreciated that the covering 106 may be a flexible material, however any suitable covering now known or hereafter developed is envisioned such as, for example, a cellular type structure, etc. Additionally, while the architectural-structure covering 100 has been illustrated and described as a TDBU covering, it should be appreciated that the present disclosure may have applicability to other now known or hereafter developed architectural-structure coverings.

Referring to FIG. 1, for the sake of convenience and clarity, all directional references or terms such as, for example, "face," "front," "back," "rear," "top," "bottom," "up," "down," "vertical," "horizontal", "inner," "outer", "proximal," "distal," "upper," "lower," "upward," "downward," "left", "right," "lateral," "longitudinal," "above," "below," "vertical," "horizontal," "radial," "axial," "clockwise," and "counterclockwise" are only used for identification purposes to aid the reader's understanding of the present disclosure, and do not create limitations, particularly as to the position, orientation, or use of this disclosure. These references are used herein to describe the relative placement and orientation of various components and portions of the architectural-structure covering 100, each with respect to the geometry and orientation of the architectural-structure covering 100 as they appear in FIG. 1. Said reference is intended to be non-limiting and is used herein merely to describe relationship between various components as illustrated in FIG. 1.

Figure 2:
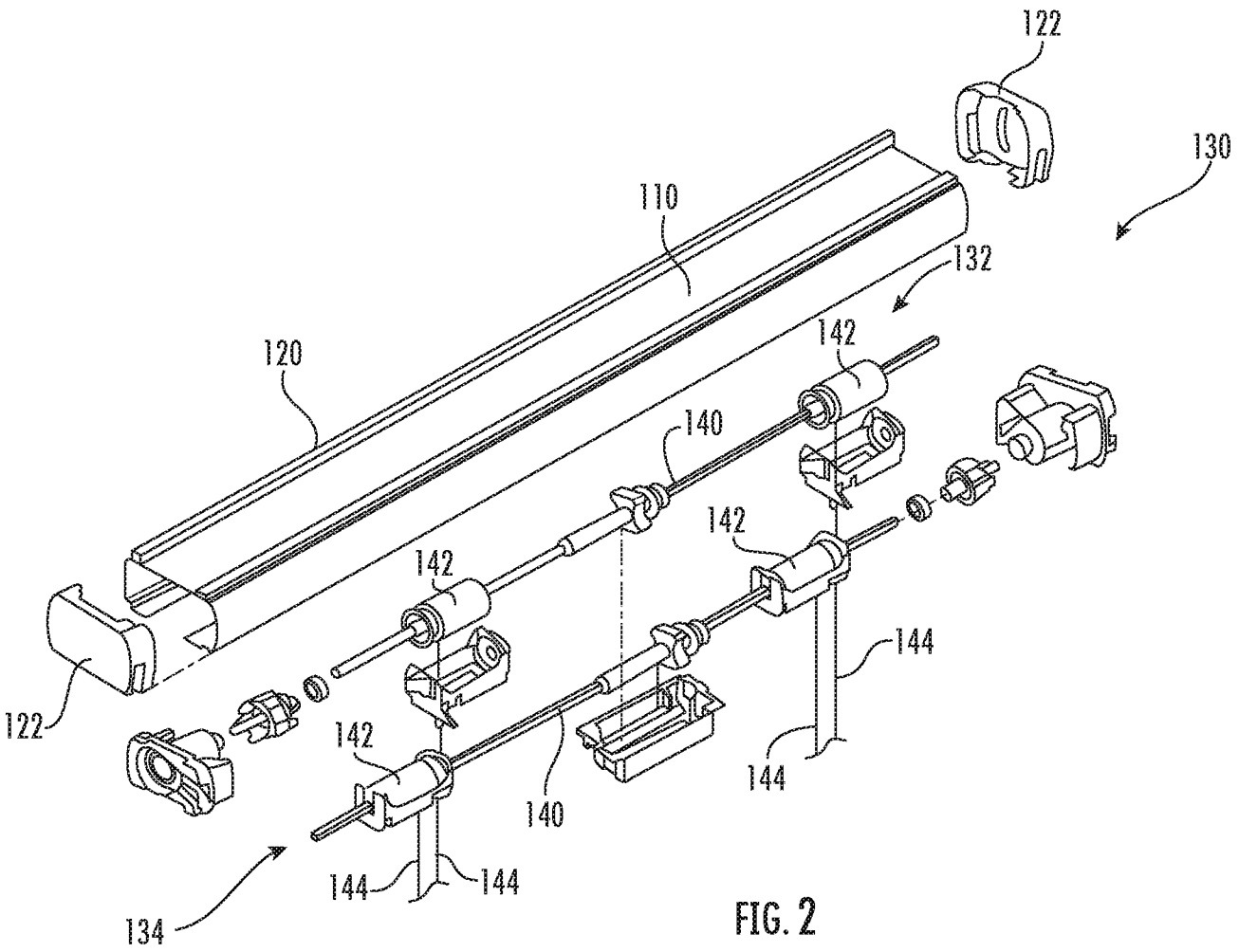
FIG. 2 is an exploded perspective of a headrail and operating system that may be used in connection with the architectural-structure covering of FIG. 1.

Referring to FIG. 2, in one accordance with one aspect of the present disclosure, the headrail 110 may include a housing 120 having opposed end caps 122 to form an open-bottom enclosure. The housing 120 may also include attachments or brackets (not shown) for coupling the headrail 110 to a structure above, or at the top of, an architectural structure, such as a wall, via mechanical fasteners, such as screws, bolts, or the like. The headrail 110 may house the rotatable member 140.

The headrail 110 generally includes or encases the operating system 130 including first and second operating subsystems 132, 134 for controlling the movable upper and bottom rails 112, 114 of the architectural-structure covering 100, respectively. Each of the first and second operating subsystems 132, 134 of the operating system 130 may be operatively associated with an operating element (not shown) for moving the movable upper and bottom rails 112, 114, respectively. The operating elements may be any suitable operating elements now known or hereafter developed including, for example, a remote control, a cord, a chain, or the like operatively associated with the operating system 130 to move the covering 106 between the extended and retracted positions. Each of the first and second operating subsystems 132, 134 may include a rotatable member 140 extending along the headrail 110 such as, for example, substantially between the opposed end caps 122 of the headrail 110. The rotatable member 140 being operatively associated with one or more cord spools 142, which are operatively coupled to lift cords 144. The opposite ends of the lift cords 144 being coupled to one of the movable upper and bottom rails 112, 114 so that rotation of the rotatable member 140 in a first direction causes the associated cord spools 142 to rotate in a first direction such as, for example, clockwise direction, to deploy or extend the lift cords 144 to move the connected rail. Similarly, rotation of the rotatable member 140 in a second direction causes the cord spools 142 to rotate in a second direction such as, for example, counterclockwise direction, to retract the lift cords 144 to move the connected rail.

As will be appreciated by one of ordinary skill in the art, the operating system 130 may include, and the headrail 110 may house, a number of additional components including, for example, housings, sprockets, gears, brackets, etc. For the purpose of brevity, the description of the structure and operation of the operating system is omitted. Moreover, although a particular example of a headrail and operating system is shown in FIG. 2, many different types and styles of headrails and operating systems exist and could be employed in place of the examples illustrated in FIG. 2. As such, the present disclosure should not be limited to any particular type of headrail, nor any particular type of operating system.

Figure 3:
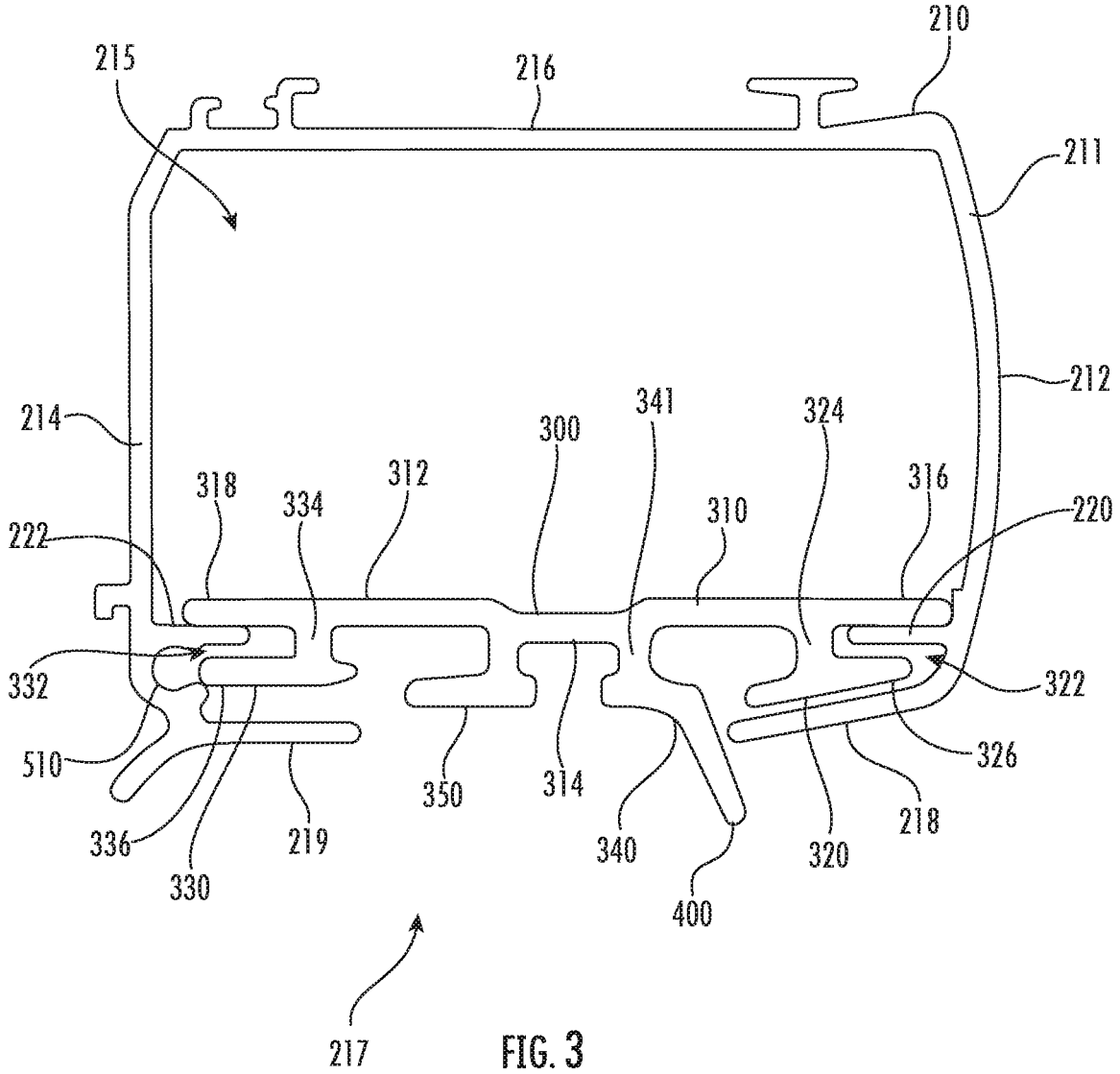
FIG. 3 is a first cross-sectional view of an example embodiment of a headrail including a slat that may be used in connection with the architectural-structure covering shown in FIG. 1 in accordance with one aspect of the present disclosure.
Figure 4:
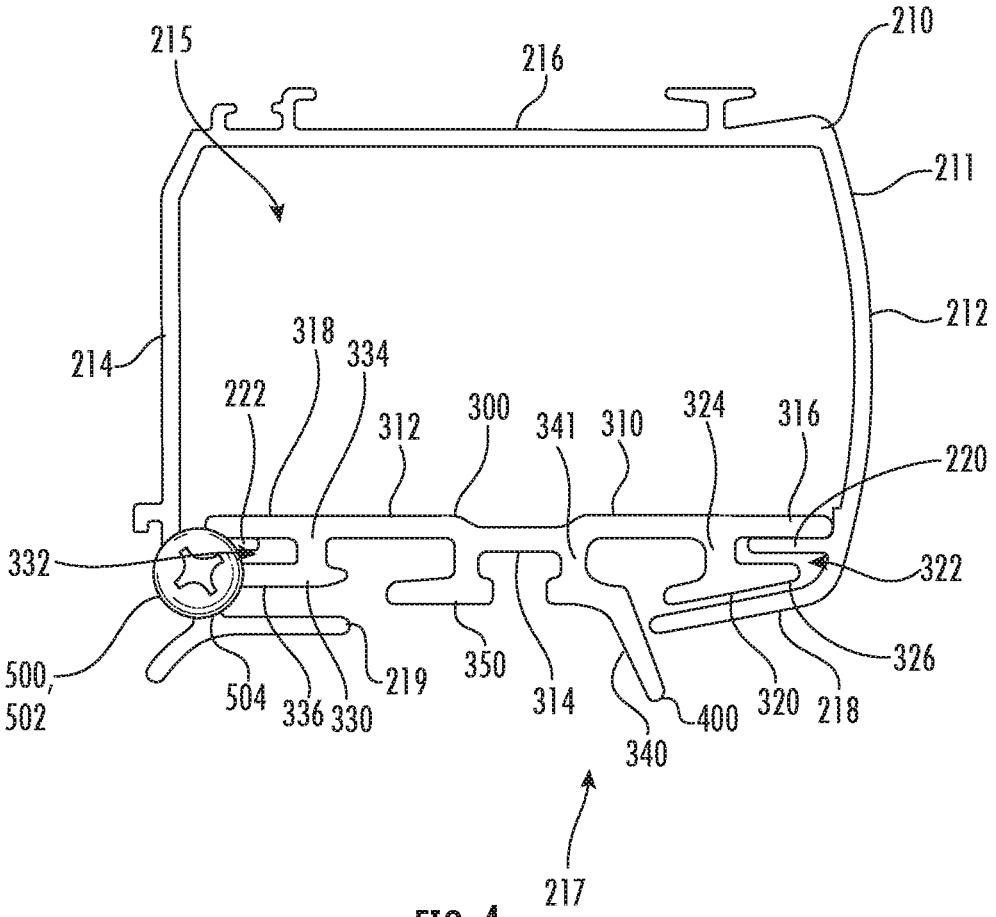
FIG. 4 is a second cross-sectional view of the headrail including the slat shown in FIG. 3, the headrail including a fixing element arranged and configured to secure the position of the slat within the headrail.
Figure 5:
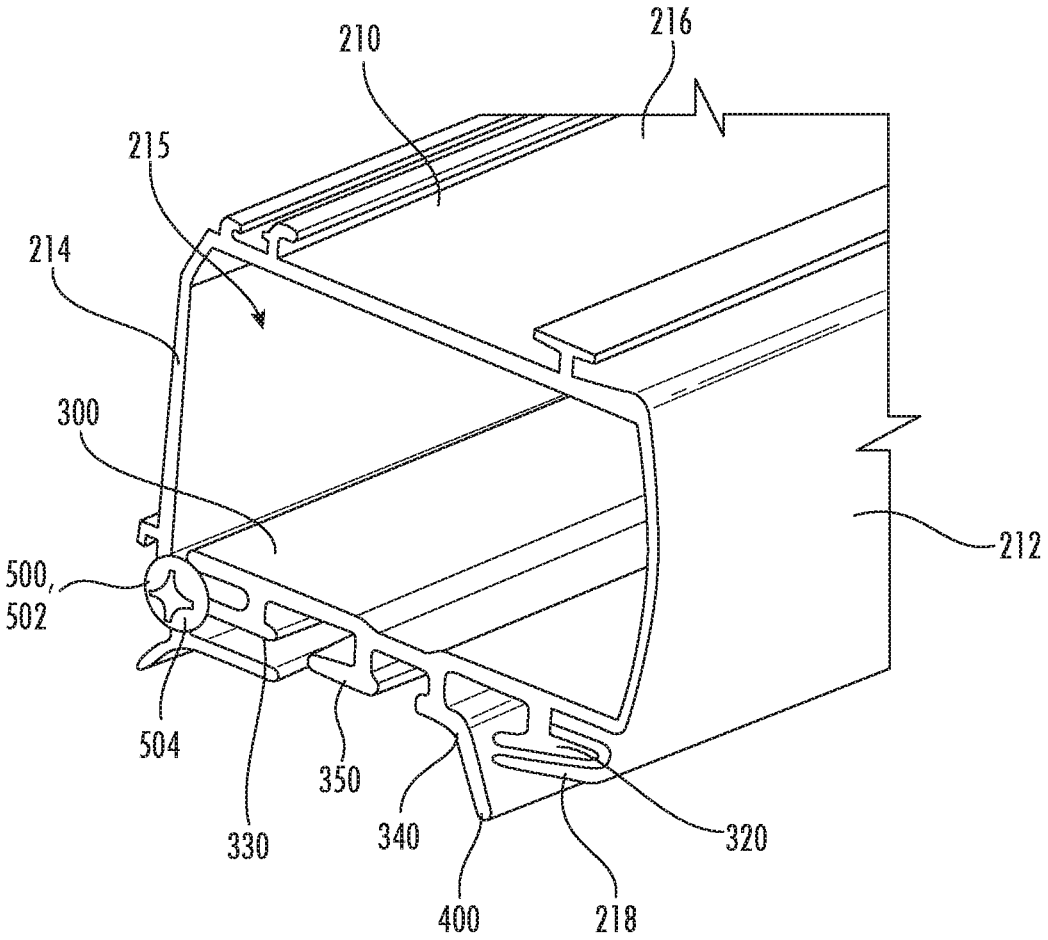
FIG. 5 is a perspective view of the headrail including the slat and the fixing element shown in FIG. 4.

Referring to FIGS. 3-5, various views of a headrail 210 illustrating one or more aspects of the present disclosure is illustrated. As illustrated, the headrail 210 may include a housing 211 including a front wall or surface 212 (used interchangeably herein without the intent to limit), a back wall 214, and a top wall 216 extending between the front wall 212 and the back wall 214. The front wall 212, the back wall 214, and the top wall 216 may define an interior cavity 215. As illustrated, the headrail 210 may include an open-bottom enclosure 217 formed by front and rear inwardly-projecting lips 218, 219 at the bottom of the headrail 210. The headrail 210 may be integrally formed. Alternatively, it is envisioned that the headrail 210 including the front wall 212, the back wall 214, and the top wall 216 may be manufactured from two or more pieces and coupled together by any suitable mechanism now known or hereafter developed. In one example embodiment, the front wall 212 may be arranged and configured to prevent, or at least minimize, shadowing. That is, the front wall 212 of the headrail 210 is arranged and configured to minimize the casting of shadows onto a top portion or top fold of the covering 106. For example, in one embodiment, as illustrated, the front wall 212 may include a reduced radius (e.g., it may assume a relatively flat appearance) to reduce shadows cast onto the top portion or top fold of the covering 106.

As illustrated, in accordance with a first separate and distinct aspect of the present disclosure, the headrail 210 may include a slat 300. As will be described in greater detail below, the slat 300 may be movably coupled such as, for example, slidably coupled or received by the headrail 210. The slat 300 is adapted and configured to receive all or some of the components such as, for example, the operating system including, for example, motor(s), rotatable member(s), spools, lift cords, etc. thereon. Thereafter, the slat 300 can be slidably positioned within the interior cavity 215 of the headrail 210 via, for example, slidably inserting the slat 300 including the components thereon from one end of the headrail 210. In this manner, the components positioned within the headrail 210 may be initially coupled to the slat 300 and coupled together as necessary outside of the tight confines of the headrail 210, thus facilitating easier and more efficient assembly of the components. Once the components have been coupled to the slat 300 and coupled to each other as necessary, the slat 300 can be slid into position within the headrail 210.

The slat 300 may be coupled to the headrail 210 by any suitable mechanism now known or hereafter developed. For example, as illustrated in the non-limiting embodiment of FIGS. 3-5, the slat 300 may include a top member 310 having a top surface 312 for receiving the components thereon, a bottom surface 314 opposite the top surface 312, a front-end portion 316, and a rear end portion 318. As illustrated, the bottom surface 314 may be integrally formed with the top surface 312 (e.g., the top member 310 may be a single member including top and bottom surfaces). Alternatively, the bottom surface 314 may be a separate member coupled to the top surface 312 (e.g., the top member 310 may be formed from separate members coupled together). The top member 310 may have a width as defined between the front-end portion 316 and the rear end portion 318 that is substantially equal to the width of the headrail 210 as defined by a distance between the front wall 212 and the back wall 214. In addition, the headrail 210 may include one or more inwardly extending projections or ledges for receiving at least a portion of the slat 300. That is, as illustrated, the headrail 210 may include a first inwardly extending projection or ledge 220 (used interchangeably herein without the intent to limit) operatively associated with the front wall 212. Similarly, the back wall 214 may include a second inwardly extending projection or ledge 222 (used interchangeably herein without the intent to limit) operatively associated with the back wall 214. The first and second inwardly extending ledges 220, 222 support the slat 300 (e.g., the bottom surface 314 of the top member 310 may rest on top of at least a portion of the first and second inwardly extending ledges 220, 222 adjacent to the front and rear end portions 316, 318 while enabling the slat 300 to be slidable relative thereto). In this manner, the first and second inwardly extending ledges 220, 222 prevent the slat 300 from passing through or falling out of the open-bottom enclosure 217 of the headrail 210.

As illustrated in FIGS. 3-5, in one example embodiment, the slat 300 may include first and second members 320, 330 defining first and second recesses 322, 332 between the first and second members 320, 330 and respective front and rear end portions 316, 318 for receiving the first and second inwardly extending ledges 220, 222 of the headrail 210. That is, as illustrated, the first and second members 320, 330 each include a first leg 324, 334 extending downwardly from the bottom surface 314 of the slat 300 and a second leg 326, 336 arranged at an angled with respect to the first leg 324, 334, respectively, to define the first and second recesses 322, 332. The second legs 326, 336 assist in positioning of the slat 300 into the headrail 210 and prevent the slat 300 from being pushed upwardly into the headrail 210 (e.g., upward movement of the slat is minimized).

As illustrated in FIGS. 3-5, the headrail 210 may include a fixing element 500 (FIGS. 4 and 5) for preventing, or at least minimizing, movement of the slat 300 relative to the headrail 210 once the slat 300 has been positioned within the headrail 210. The fixing element 500 may be any fixing element 500 now known or hereafter developed for preventing, or at least minimizing, movement of the slat 300 relative to the headrail 210 (e.g., fixing element 500 couples the slat 300 to the headrail 210 to prevent, for example, lateral sliding of the slat 300 relative to the headrail 210). The headrail 210 may include a boss 510 (FIG. 3) for receiving the fixing element 500. After insertion of the slat 300 into the headrail 210, insertion of the fixing element 500 secures the position of the slat 300 relative to the headrail 210, and thus prevents, or at least minimizes, movement of the slat 300 relative to the headrail 210.

The boss 510 may be positioned and configured in any suitable manner so that receipt of the fixing element 500 with the boss 510 prevents, or at least minimizes, movement of the slat 300 relative to the headrail 210. For example, as illustrated, the back wall 214 of the headrail 210 may be extruded to include the boss 510, although other positions and configurations are envisioned. The boss 510 may be positioned at either end, or at both ends, of the headrail 210 so that fixing elements 500 may be positioned at either, or both, ends of the headrail 210. In addition, while the boss 510 has been illustrated as being formed along the back wall 214, it is envisioned that the boss 510 may be located along the front wall 212. Moreover, any number of bosses 510 and fixing elements 500 may be utilized. In one embodiment, the fixing element 500 and the boss 510 may be arranged and configured so that insertion of the fixing element 500 into the boss 510 causes the slat 300 to shift away from the back wall 214 and towards the front wall 212 to reduce light gaps between the slat 300 and the headrail 210. That is, the fixing element 500 and the boss 510 may be arranged and configured so that insertion of the fixing element 500 pushes, biases, etc. the slat 300 forward towards the front wall 212 of the headrail 210.

As illustrated, the fixing element 500 may be a threaded screw 502 (FIGS. 4 and 5) having an enlarged head portion 504 (FIGS. 4 and 5). If the fixing element 500 is a threaded screw, the boss 510 may be in the form of a threaded opening positioned and configured so that engagement of the screw 502 with the boss 510 prevents, or at least minimizes, movement of the slat 300 relative to the headrail 210. Insertion of the screw 502 causes the screw head or enlarged head portion 504 to be positioned relative to the slat 300 to prevent, or at least minimize, movement (e.g., lateral sliding) of the slat 300 relative to the headrail 210.

Referring to FIGS. 3-5, in accordance with another separate and distinct aspect of the present disclosure that may be used separately from, or in combination with, the other aspects of the headrail and/or architectural-structure covering disclosed herein (e.g., the separate and distinct aspect may be used in combination with a slat having the features described above, or may be used with a conventional slat not having all or some of the features disclosed herein), a slat (e.g., a slat coupled to a bottom side of a headrail), such as, for example, the slat 300 described above, includes a light-blocking element 400 for preventing or at least inhibiting light from entering through any gaps formed between the movable upper rail 112 and the headrail 210 when the movable upper rail 112 is positioned adjacent to the headrail 210. As illustrated, the light-blocking element 400 may be integrally formed with the slat 300. That is, for example, as illustrated, the slat 300 may include a third member 340 extending from the bottom surface 314 of the top member 310 of the slat 300. The third member 340 may include a light-blocking element. For example, as illustrated, the third member 340 may include a downwardly extending first leg 341. In addition, the third member 340 may include the light-blocking element 400, which may depend from the first leg 341. The light-blocking element 400 may be coupled to or integrally formed with the first leg 341 of the third member 340. As illustrated, the light-blocking element 400 may extend at an angle relative to the first leg 341 of the third member 340 and may extend downwardly from the slat 300. The light-blocking element 400 is arranged and configured to extend across any gap between the headrail 210 and a top surface of the movable upper rail 112 for preventing or at least inhibiting light from entering between the headrail 210 and the movable upper rail 112 when the movable upper rail 112 contacts the headrail 210.

That is, a light gap between the movable upper rail 112 and the headrail 210 may exist, and the light gap may be uniform or non-uniform, and may result from any of a variety of conditions.

The light-blocking element 400 is positioned to enable the rail (e.g., movable upper rail 112) to be positionable adjacent to the headrail 110. As illustrated, the light-blocking element 400 may be positioned adjacent to an end portion of the front inwardly-projecting lip 218 to enable sufficient room for the rail (e.g., movable upper rail 112), however it is envisioned that the light-blocking element 400 may be formed anywhere along a width of the slat 300.

The light-blocking element 400 of the illustrated embodiment is integrally formed with the slat 300. In one example embodiment, if a portion of the movable upper rail 112 contacts the light-blocking element 400, the light-blocking element 400 can conform to the top surface of the movable upper rail 112, thereby covering any gap between the movable upper rail 112 and the headrail 210 to prevent or at least inhibit light from passing through the gap. In one example embodiment, the light-blocking element 400 is arranged and configured to be deflectable so that as the movable upper rail 112 is moved towards the headrail 210, the elongated light-blocking element 400 accommodates for any gaps between the headrail 210 and the movable upper rail 112.

Figure 6:
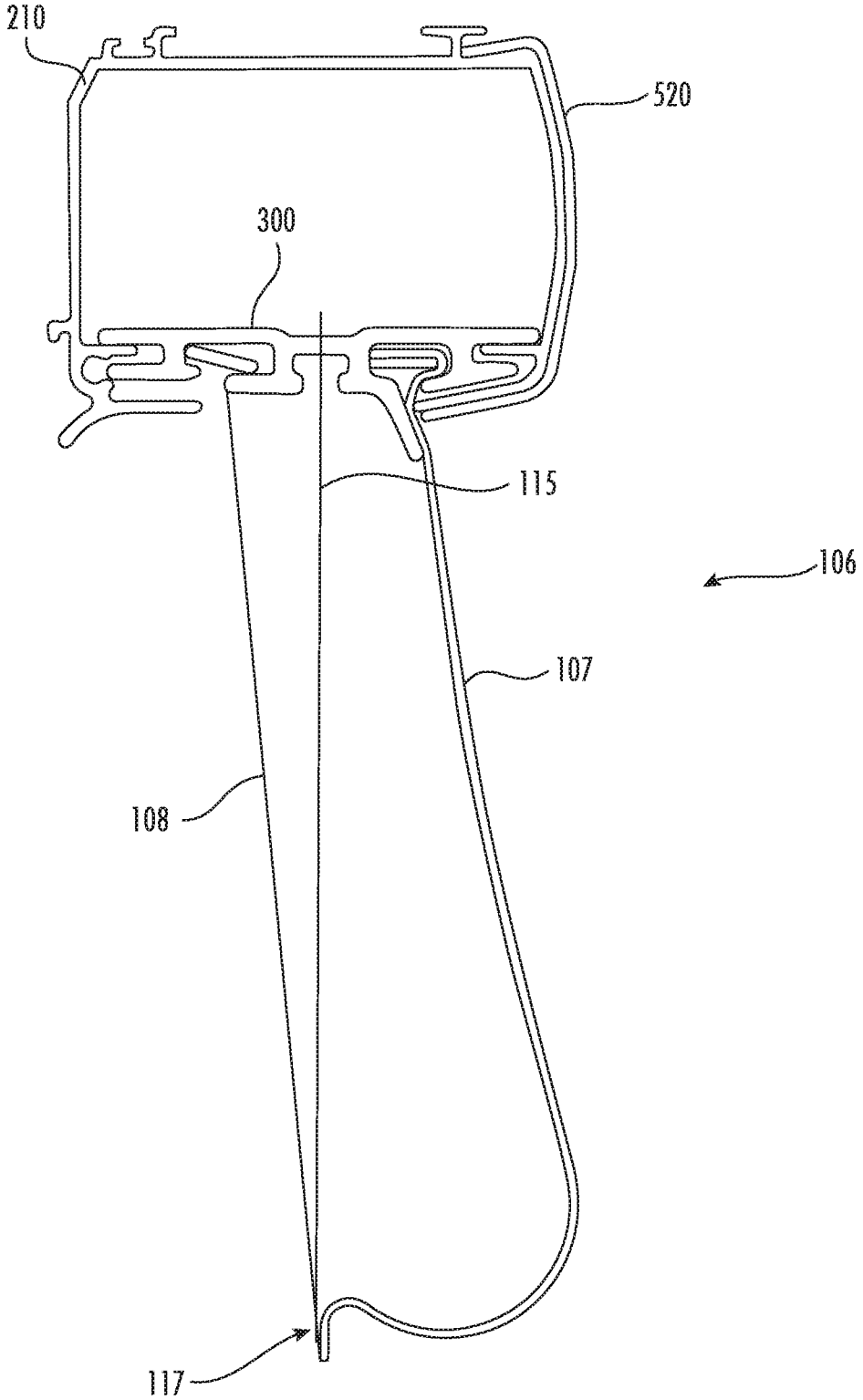
FIG. 6 is a cross-sectional view of an example embodiment of a headrail and separated face and back fabrics that may be used in connection with the architectural-structure covering shown in FIG. 1 in accordance with one aspect of the present disclosure.

Referring to FIG. 6, in accordance with another separate and distinct aspect of the present disclosure that may be used separately from, or in combination with, the other aspects of the headrail previously disclosed herein (e.g., the separate and distinct aspect may be used in combination with a slat having one or more of the features described above, or may be used with a conventional slat not having all or some of the features disclosed herein), in one non-limiting example embodiment, the covering 106 may be manufactured from a fabric material including a face fabric 107 and a back fabric 108. It should be understood that the covering as shown is but one example and that other configurations may be used.

It should also be understood that the covering as shown may be used in combination with the headrail 110 previously disclosed and shown, or may be used independently thereof.

The covering 106 may include lift elements 115 (e.g., lift cords) extending from the headrail 210 to the movable bottom rail 114 (FIG. 1) and disposed between the face fabric 107 and the back fabric 108. The lift elements 115 may be operative to move the movable bottom rail 114 and the movable upper rail 112 relative to each other in the case of a TDBU covering, or to move the bottom rail toward the headrail in a conventional covering. The face and back fabrics 107, 108 may be coupled to each other along vertically-spaced lines of attachment 117 extending across a width of the covering 106, the vertically spaced lines of attachment 117 including intermittent spaces to define vertically-aligned gaps through which the lift elements 115 movably pass. That is, as will be appreciated by one of ordinary skill in the art, the lift elements 115 may extend downwardly from the headrail 210 in a path defined between the face and back fabrics 107, 108 of the covering 106. The face fabric 107 may be coupled intermittently to the back fabric 108 along vertically-spaced lines of attachment 117 that extend horizontally across a width of the covering 106 to define vertically-aligned gaps between the face and back fabrics 107, 108 through which the lift elements 115 may move (e.g., slide). During extension of the covering 106, the lift elements 115 may move downwardly through the gaps relative to the face and back fabrics 107, 108 to move, for example, the bottom rail relative to the upper rail and/or the headrail. During retraction of the covering 106, the lift elements 115 may move upwardly through the gaps relative to the face and back fabrics 107, 108 to move the bottom rail relative to the upper rail and/or the headrail.

Referring to FIG. 6, in accordance with another separate and distinct aspect of the present disclosure that may be used separately from, or in combination with, the other aspects disclosed herein (e.g., the separate and distinct aspect may be used in combination with a slat having one or more of the features described above, or may be used with a conventional slat not having all or some of the features disclosed herein), the face and back fabrics 107, 108 may be separated from each other at the top portion or fold thereof (e.g., the top portion or fold of the covering 106 positioned adjacent to the headrail 210). Thereafter, each of the face and back fabrics 107, 108 may be separately and independently associated with a portion of the architectural-structure covering such as, for example, the headrail 210, a rotatable roller, or the like (e.g., a top portion or fold of the covering 106 including the face and back fabrics 107, 108 may be coupled to, for example, a headrail, a rotatable roller, or the like). In this manner, by coupling the back fabric 108 from a spaced location relative to the face fabric 107 a spacing is created between the face and back fabrics 107, 108 at the top portion or fold of the covering 106, which in turn reduces any pinching of the top portion or fold of the covering 106. That is, thus arranged, pinching of the top portion or fold of the covering 106 is prevented, or at least minimized. In addition, visualization of the lift elements 115 through the face fabric 107 at the top portion or fold of the covering 106 is prevented, or at least minimized.

Figure 7:
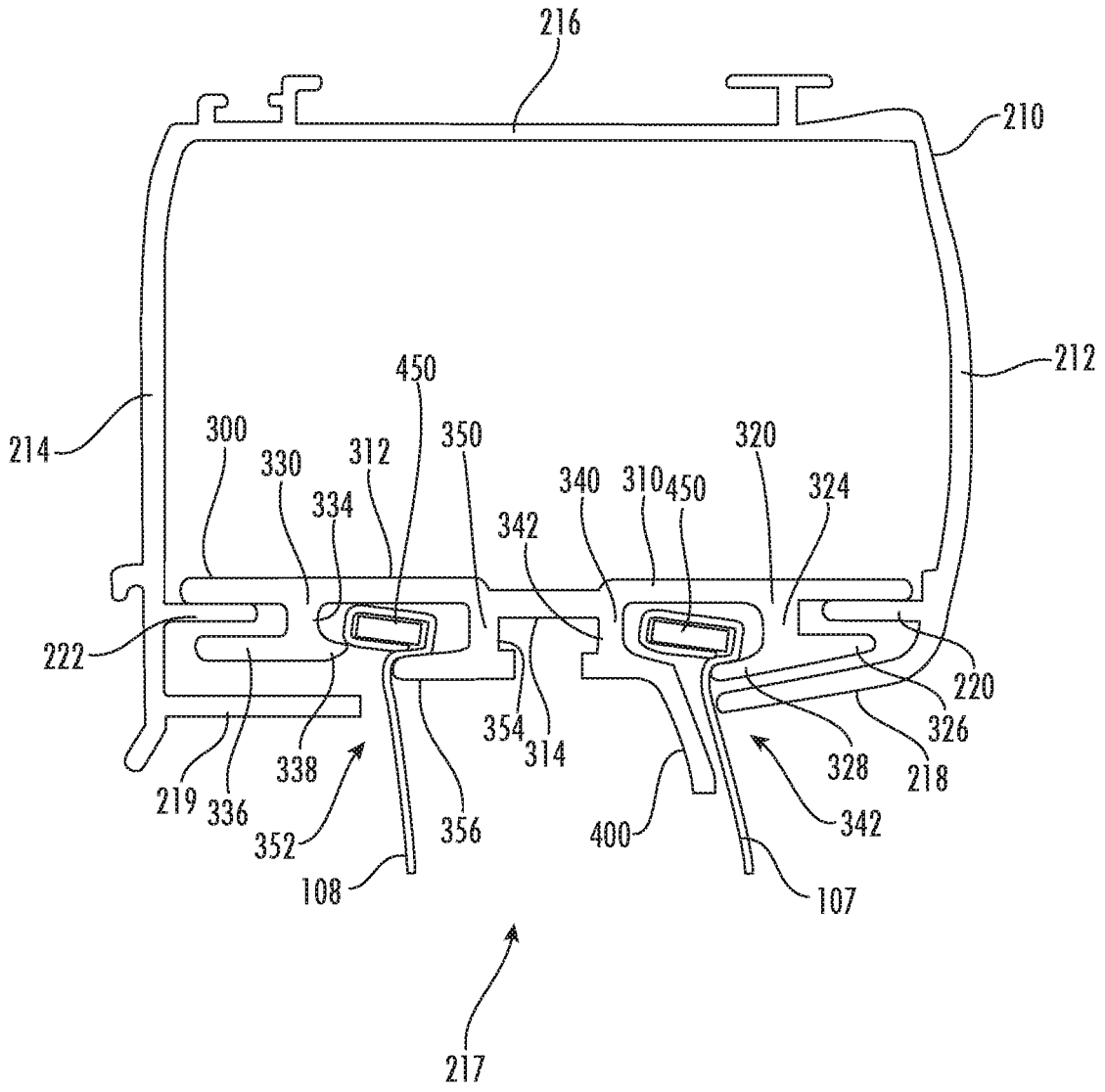
FIG. 7 is another cross-sectional view of the headrail and separated face and back fabrics shown in FIG. 6.
Figure 8A:
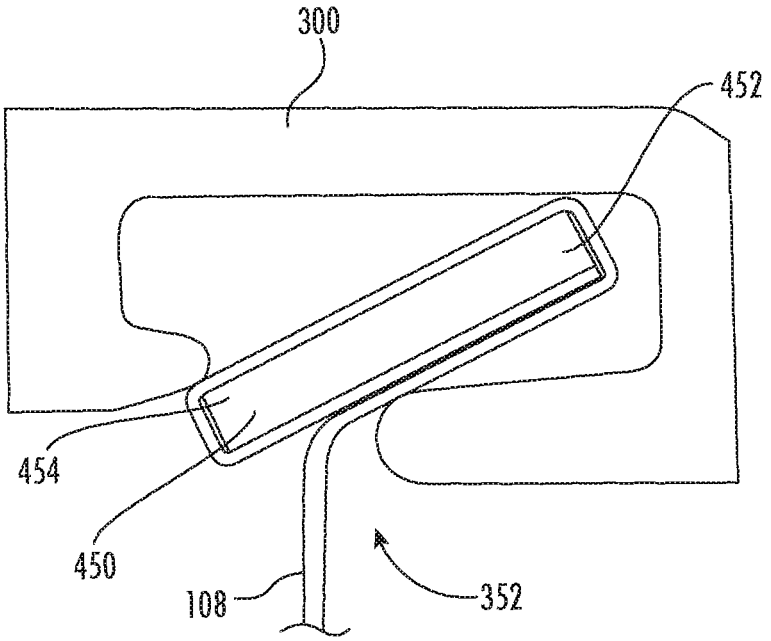
FIGS. 8A-8E is a detailed cross-sectional view illustrating a sequence of steps for inserting a top end portion of a fabric into a recess in accordance with one aspect of the present disclosure.
Figure 8B:
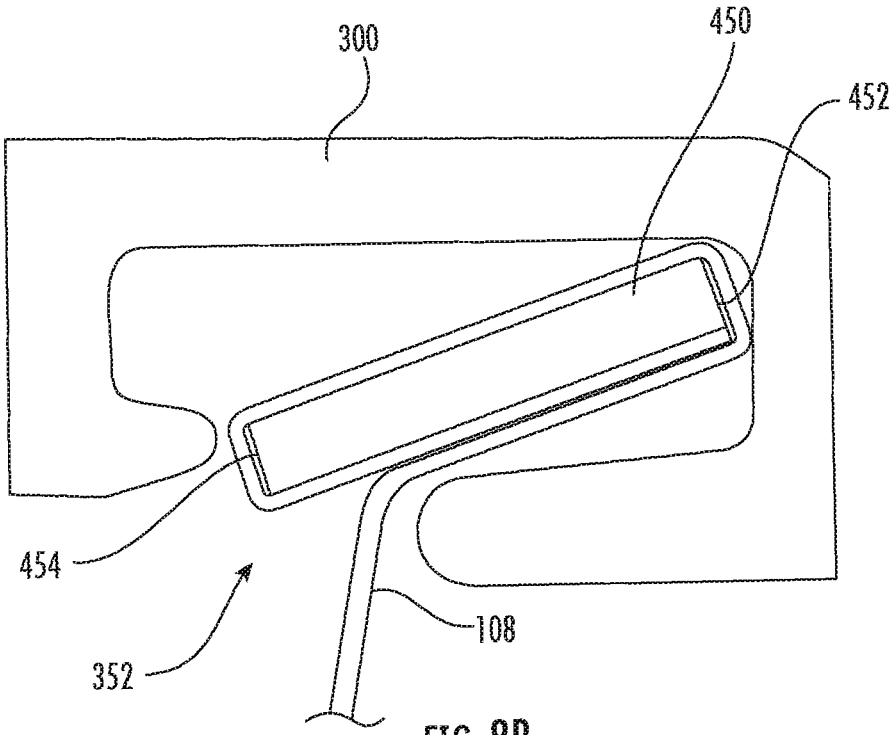
Figure 8C:
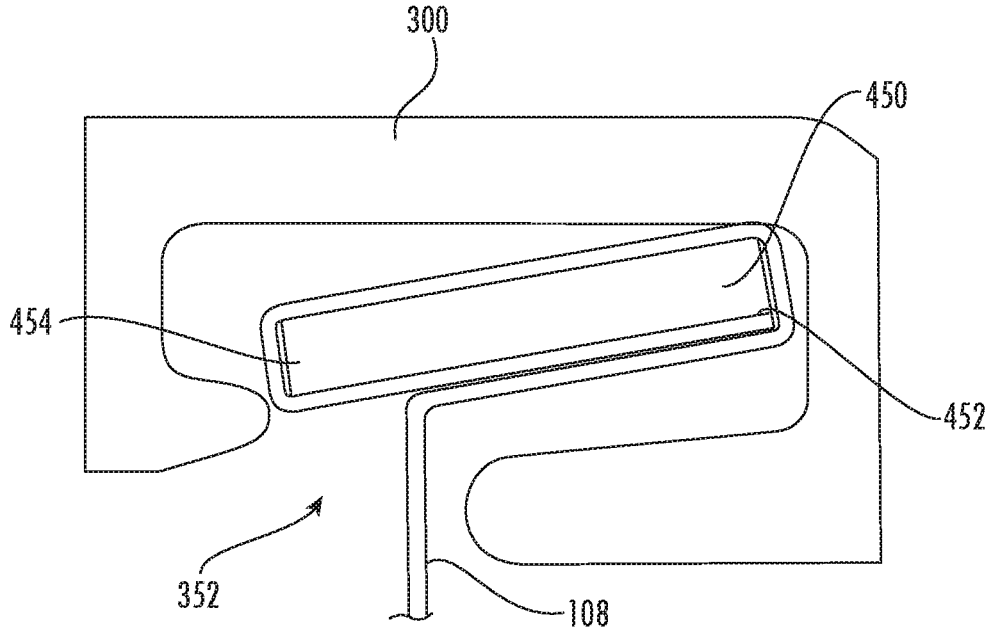
Figure 8D:
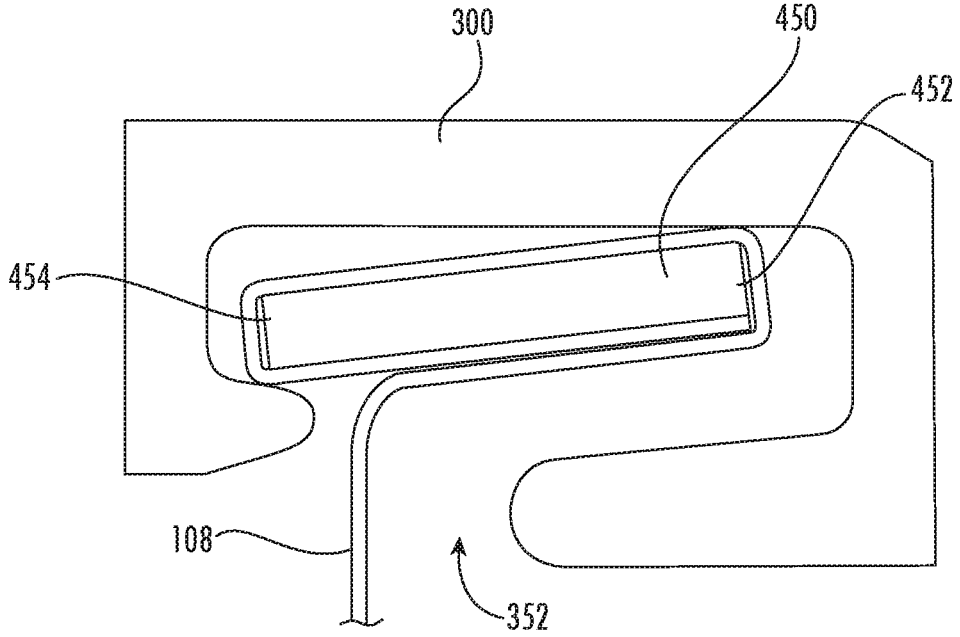
Figure 8E:
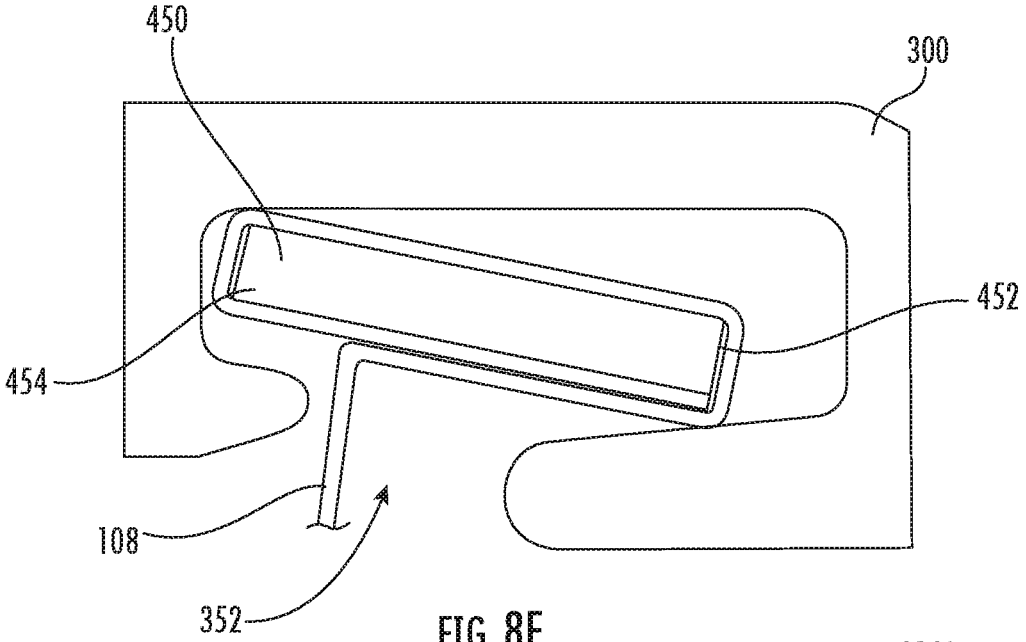

Referring to FIGS. 6 and 7, as illustrated, in one example embodiment, the face and back fabrics 107, 108 are independently and separately coupled to the slat 300. That is, as illustrated, the slat 300 may include recesses 342, 352 for respectively receiving an end portion of the face and back fabrics 107, 108. As will be described herein, the recesses 342, 352 formed in the slat 300 for respectively receiving the face and back fabrics 107, 108 shall be referred to as third and fourth recesses 342, 352. However, it should be appreciated that the slat 300 need not include all four recesses. That is, the slat 300 may include first and second recesses 322, 332 for receiving first and second inwardly extending ledges 220, 222, respectively, as previously described and third and fourth recesses 342, 352 for receiving the face and back fabrics 107, 108. Alternatively, the slat 300 may include either the first and second recesses 322, 332 for receiving first and second inwardly extending ledges 220, 222, respectively, or the third and fourth recesses 342, 352 for receiving the face and back fabrics 107, 108.

As illustrated, the first member 320 extending from the bottom surface 314 of the top member 310 may include a third leg 328 opposite the second leg 326, the third leg 328 extending at an angle relative to the first leg 324 of the first member 320. The first member 320 and the third member 340 may define the third recess 342 for receiving the top end portion of the face fabric 107. For example, in one embodiment, the first member 320 and the third member 340 including, for example, the light-blocking element 400, may define the third recess 342 for receiving the top end portion of the face fabric 107. In addition, the slat 300 may include a fourth member 350. The fourth member 350 can include a first leg 354 extending downwardly from the bottom surface 314 of the top member 310 and a second leg 356 extending at an angle relative to the first leg 354. In addition, as illustrated, the second member 330 may include a third leg 338 extending opposite the second leg 336, the third leg 338 arranged at an angle with respect to the first leg 334 of the second member 330. The second member 330 and the fourth member 350 may define the fourth recess 352 for receiving a top end portion of the back fabric 108. It should be understood that while a specific embodiment of the slat 300 has been described and illustrated, the slat 300 only needs to incorporate recesses for receiving the top portion of the face and back fabrics 107, 108.

The top end portion of the face and back fabrics 107, 108 may be coupled to the slat 300 by any suitable mechanism now known or hereafter developed including, for example, an adhesive. Referring to FIGS. 6 and 7 in one example embodiment, the top end portions of the face and back fabrics 107, 108 may be wrapped around a strip 450 and then subsequently inserted into the third and fourth recesses 342, 352 formed in the slat 300.

Referring to FIGS. 8A-8E, which illustrates a sequence of steps for inserting the top end portion of the back fabric 108 into the fourth recess 352, in one example embodiment, the top edge of the face and back fabrics 107, 108 may be wrapped about a strip 450 such as a polycarbonate strip or "polystrip" (commonly used in the industry to couple fabrics to a more rigid element, such as by insertion of the fabric wrapped around an edge of the polycarbonate strip, into a recess). The strip 450, along with the portion of the back fabric 108 wrapped thereabout, may be inserted into the fourth recess 352 formed in the slat 300, past the space or gap between the leg portions of the second and fourth members 330, 350, and into the recess 352 formed in the slat 300. As illustrated, the legs of the second and fourth members 330, 350 are sized and configured to enable the strip 450, along with the portion of the back fabric 108 of the covering 106 wrapped thereabout, to be pressed or rolled into the recess 352 formed in the slat 300 during insertion, while simultaneously restricting the strip 450, along with the portion of the back fabric 108 wrapped thereabout, from moving out of the recess 352 (e.g., to slide past the legs of the second and fourth members and out of the recess 352 to disengage the back fabric 108 from the slat 300). During installation, the strip 450 and the portion of the back fabric 108 can be inserted into the recess 352 by inserting a first portion 452 (e.g., illustrated as right side) of the strip 450 and the portion of the back fabric 108 wrapped thereabout in-between the space created by the leg portions of the second and fourth members. Thereafter, the strip 450 and the portion of the back fabric 108 wrapped thereabout can be moved to one side of the recess 352 such as, for example, forward (e.g., towards the right) until the second portion 454 (e.g., illustrated as the left side) of the strip 450 and the portion of the back fabric 108 can be pushed into the recess 352. Once the strip 450 and the fabric portion wrapped thereabout have been fully received within the recess 352, tensioning of the covering 106 (e.g., pulling downwards on the covering 106) causes the strip 450 and fabric to rest on a top surface of the legs thereby preventing the strip and fabric from falling out of the recess 352. In one example embodiment, as illustrated, the strip 450 and the portion of the fabric 108 wrapped thereabout are maintained in place within the recess 352 due in part to the asymmetric design of the legs forming the recess 352. Alternatively, the strip 450 and the fabric wrapped thereabout can be slid into the recess from an end of the headrail 210.

In one example embodiment, the openings to the recesses 342, 352 may be arranged and configured to facilitate insertion of the strip 450 and the portion of the fabric wrapped thereabout. For example, the legs forming the recesses 342, 352 may include a tapered end portion to assist with insertion of the strip 450 and the portion of the fabric wrapped thereabout. Meanwhile, accidental removal of the strip 450 along with the portion of the fabric wrapped thereabout may be rendered more difficult as, during removal, the strip 450 and fabric wrapped thereabout, may contact a straight edge bottom surface of the recesses 342, 352, which tend to prevent the strip 450 and fabric wrapped thereabout, from sliding through the space or gap formed between the legs defining the recesses 342, 352. It should be understood that while insertion of the back fabric 108 has been illustrated and described, the description applies equally to insertion of the face fabric 107 into the third recess 342.

The strip 450 may be coupled to the face and back fabrics 107, 108 by any suitable means now known or hereafter developed. For example, the strip 450 may be provided with an adhesive on the front and back surfaces thereof. After coupling the strip 450 to or adjacent to the top edge of the face and back fabrics 107, 108, any remaining portion of the face and back fabrics 107, 108 located above the strip 450 may be removed. Thereafter, the top edge of the face and back fabrics 107, 108 may be wrapped about the strip 450. In one example embodiment, the back fabric 108 may be double wrapped about the strip 450 so that the strip 450 completely surrounds or wraps within the back fabric 108. Meanwhile, the face fabric 107 may be partially wrapped about the strip 450 so that only a portion (e.g., top surface) of the strip 450 is covered or wrapped with the face fabric 107. The greater the number of fabric wraps around the strip 450, the stronger the hold. As such, since the back fabric 108 is carrying more of the weight, the back fabric 108 may be double wrapped. Meanwhile, since the face fabric 107 is carrying less weight, the face fabric 107 may be partially wrapped or wrapped only once about the strip 450. The recesses 342, 352 for receiving an end portion of the face and back fabrics 107, 108, respectively, are arranged and configured to pinch the fabric, thus the more weight applied to the fabric, the better pinch or coupling obtained.

Figure 9:
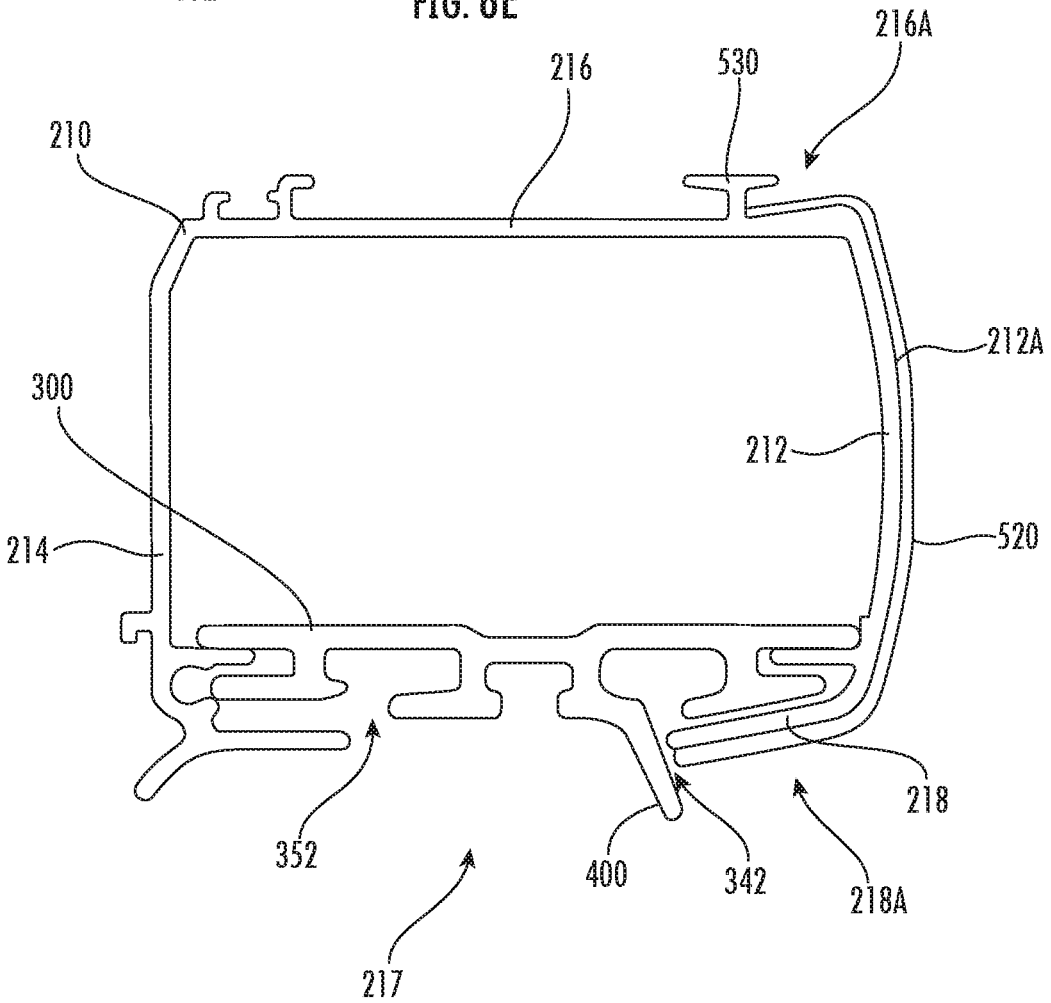
FIG. 9 is a cross-sectional view of an example embodiment of a headrail that may be used in connection with the architectural-structure covering shown in FIG. 1 in accordance with one aspect of the present disclosure, the headrail including a first fabric coupled to a front surface of the headrail.
Figure 10:
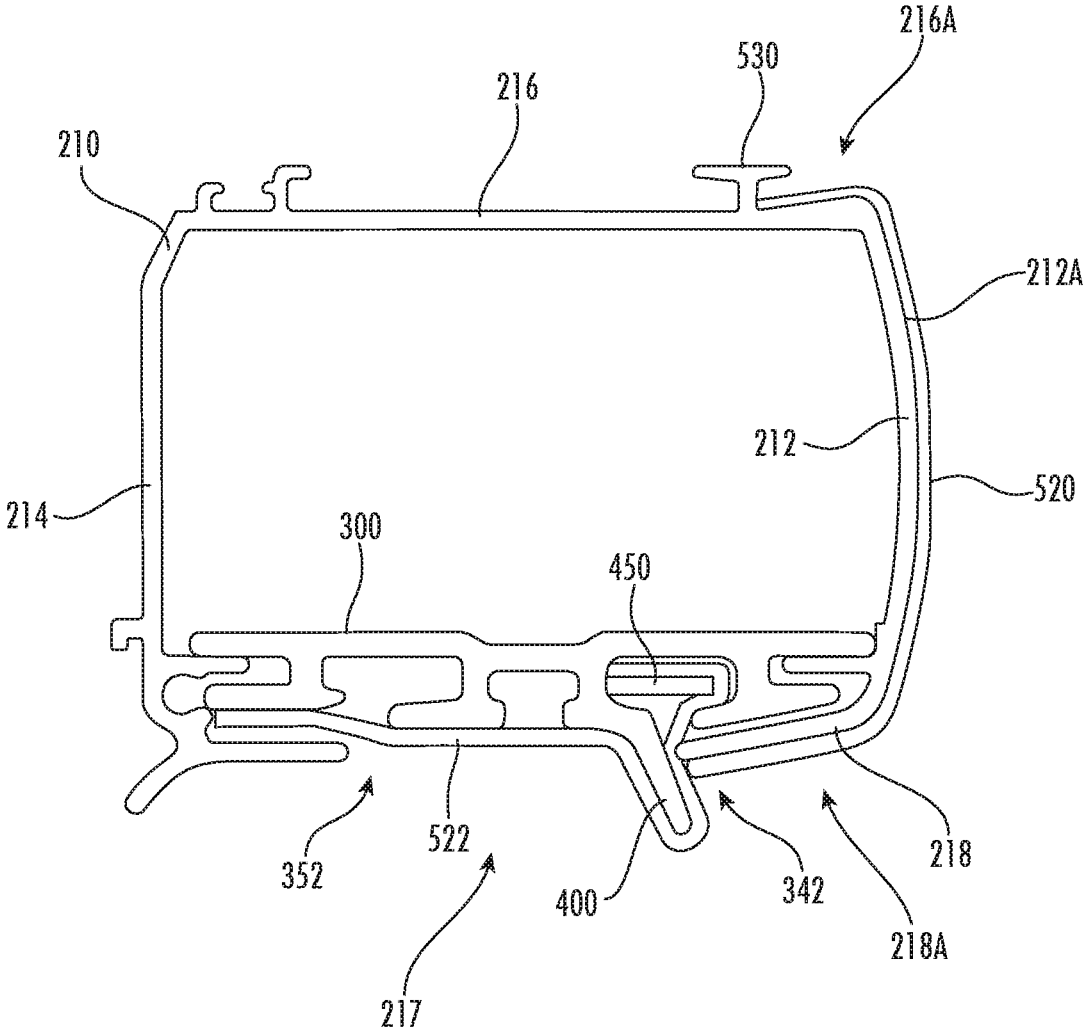
FIG. 10 is a cross-sectional view of the headrail shown in FIG. 9, the headrail further including a second fabric coupled to a bottom portion of the headrail.

Referring to FIGS. 9 and 10, in accordance with another separate and distinct aspect of the present disclosure that may be used separately from, or in combination with, the other aspects of the headrail previously disclosed herein, in one non-limiting example embodiment, the headrail 210, and more specifically, the front surface 212A of the headrail 210 may include a fabric 520 (referred to herein as a first fabric) coupled thereto. The first fabric 520 may be coupled to the front surface 212A of the headrail 210 by any suitable method now known or hereafter developed including, for example, via an adhesive. As illustrated, the first fabric 520 may be arranged and configured to extend and cover at least a front portion 216A of the top wall 216 and at least a portion 218A of the front inwardly-projecting lip 218. That is, as illustrated, the first fabric 520 may be laid over the front surface 212A of the headrail 210 and over at least a front portion 216A of the top wall 216 and a portion 218A of the bottom surface of the headrail 210. By extending and tucking an edge of the first fabric 520 under, for example, a rib 530 extending from the top wall 216 of the headrail 210 and over at least a portion 218A of the bottom edge of the headrail 210, improved aesthetics can be achieved.

As illustrated in FIG. 10, in addition a second fabric 522 may be used to cover the open-bottom enclosure 217 of the headrail 210, for example, when a covering 106 is not coupled or in close proximity thereto. In this manner, the slat 300 may be utilized even when a covering 106 is not coupled or in close proximity to the headrail 210 such as, for example, in connection with a TDBU covering. Thus arranged, the slat 300 may also be covered with fabric for aesthetic purposes in a TDBU covering. The second fabric 522 may be coupled to the headrail 210 and/or slat 300 by any suitable mechanism now known or hereafter developed. For example, as illustrated, the second fabric 522 may be coupled to and/or wrapped about a strip 450, as previously described, and the strip 450 and portion of the second fabric 522 wrapped thereabout may be inserted into the recess 342. Thereafter, the remaining portions of the second fabric 522 may be coupled to the light-blocking element 400 and slat 300 via, for example, an adhesive.

As will be appreciated by one of ordinary skill in the art, when utilized with a light-blocking element 400, the surface area of the slat 300 to be covered is increased. In one embodiment, as illustrated, the height of the first fabric 520 for coupling to the front surface 212A of the headrail 210 and the height of the second fabric 522 for covering the open-bottom enclosure 217 of the headrail 210 may have the same dimension. That is, the dimension of the first fabric 520 for covering the front surface 212A of the headrail 210 is the same as the dimension for the second fabric 522 for covering the slat 300 and light-blocking element 400. In this manner, utilization of first and second fabrics 520, 522 with the same dimensions to cover two separate elements simplifies assembly and reduces the overall number of stock-keeping units or "SKU's" (e.g., the same SKU can be used for the first and second fabrics).

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As used herein, an element or step recited in the singular and proceeded with the word "a" or "an" should be understood as not excluding plural elements or steps, unless such exclusion is explicitly recited.

The phrases "at least one", "one or more", and "and/or", as used herein, are open-ended expressions that are both conjunctive and disjunctive in operation. The terms "a" (or "an"), "one or more" and "at least one" can be used interchangeably herein. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

What is claimed:

1. A headrail for use with an architectural-structure covering, the architectural-structure covering including a covering movable between an extended position and a retracted position, and an operating system to move the covering between the extended and retracted positions, the headrail comprising:

a housing including a front wall, a back wall, and a top wall extending between said front wall and said back wall, said front wall, said back wall, and said top wall defining an interior cavity, said housing further including a first ledge extending into said interior cavity from said front wall and a second ledge extending into said interior cavity from said back wall; and a slat including a top surface and a bottom surface opposite said top surface, said slat being slidably receivable within said interior cavity of said housing, said top surface of said slat being adapted and configured to receive the operating system thereon prior to insertion of said slat into said interior cavity of said housing;

wherein said slat includes:

first and second recesses arranged and configured to receive said first and second ledges, respectively, of said housing;

third and fourth recesses arranged and configured to receive a top portion of a face fabric and a top portion of a back fabric, respectively, of the covering so that said face fabric and said back fabric are coupled to said slat at independent and spaced apart locations; and a light-blocking element extending from the bottom surface of the slat, the light-blocking element being arranged and configured to inhibit light passage.

2. The headrail of claim 1, wherein said slat includes a front-end portion, a rear end portion, and a width defined between said front and rear end portions equal to a width of said headrail defined by a distance between said front wall and said back wall.

3. The headrail of claim 1, further comprising:

first and second legs formed in said slat positioned beneath said first and second recesses, respectively, arranged and configured to minimize upward movement of said slat.

4. The headrail of claim 1, wherein said light-blocking element is configured to inhibit light from passing between a movable upper rail and said headrail when said movable upper rail is positioned adjacent to said headrail.

5. The headrail of claim 1, wherein said light-blocking element is integrally formed with said slat.

6. The headrail of claim 1, further comprising a fixing element arranged and configured to secure a position of said slat relative to said housing.

7. The headrail of claim 6, wherein said fixing element is arranged and configured so that insertion of said fixing element biases said slat towards said front wall of said housing.

8. An architecture-structure covering comprising:

a covering movable between an extended position and a retracted position;

an operating system to move the covering between the extended and retracted positions, the operating system including one or more components selected from a motor, a rotatable member, and spools operatively associated with lift cords;

a headrail including a housing including a front wall, a back wall, and a top wall extending between the front wall and the back wall, the front wall, the back wall, and the top wall defining an interior cavity, the housing further including a first ledge extending into the interior cavity from the front wall and a second ledge extending into the interior cavity from the back wall; and a slat including a top surface and a bottom surface opposite the top surface, the slat being slidably receivable within the interior cavity of the housing with the slat resting on the first and second ledges, the operating system being coupled to the top surface of the slat prior to the slat being received with the interior cavity of the housing.

9. The architecture-structure covering of claim 8, wherein the slat includes a front-end portion, a rear end portion, and a width defined between the front and rear end portions equal to a width of the headrail defined by a distance between the front wall and the back wall.

10. The architecture-structure covering of claim 8, wherein the slat includes first and second recesses arranged and configured to receive the first and second ledges, respectively, of the housing.

11. The architecture-structure covering of claim 10, wherein the slat further includes third and fourth recesses arranged and configured to receive a top portion of a face fabric and a top portion of a back fabric, respectively, of the covering so that the face fabric and the back fabric are coupled to the slat at independent and spaced apart locations.

12. The architecture-structure covering of claim 11, wherein the slat further includes a light-blocking element extending from the bottom surface of the slat, the light-blocking element being arranged and configured to inhibit light passage.

13. The architecture-structure covering of claim 10, wherein the slat further includes first and second legs formed in the slat positioned beneath the first and second recesses, respectively, arranged and configured to minimize upward movement of the slat.

14. The architecture-structure covering of claim 8, wherein the slat further includes a light-blocking element extending from the bottom surface of the slat, the light-blocking element being arranged and configured to inhibit light passage.

15. The architecture-structure covering of claim 14, wherein the light-blocking element is configured to inhibit light from passing between a movable upper rail and the headrail when the movable upper rail is positioned adjacent to the headrail.

16. The architecture-structure covering of claim 14, wherein the light-blocking element is integrally formed with the slat.

17. The architecture-structure covering of claim 8, further comprising a fixing element arranged and configured to secure a position of the slat relative to the housing.

18. The architecture-structure covering of claim 17, wherein the fixing element is arranged and configured so that insertion of the fixing element biases the slat towards the front wall of the housing.

* * * * *